US012037747B2

(12) United States Patent
Kanamaru

(10) Patent No.: US 12,037,747 B2
(45) Date of Patent: Jul. 16, 2024

(54) WATER DISPERSIBLE SHEET

(71) Applicant: DAIO PAPER CORPORATION, Shikokuchuo (JP)

(72) Inventor: Kaori Kanamaru, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 227 days.

(21) Appl. No.: 17/634,848

(22) PCT Filed: Sep. 11, 2020

(86) PCT No.: PCT/JP2020/034534
§ 371 (c)(1),
(2) Date: Feb. 11, 2022

(87) PCT Pub. No.: WO2021/065423
PCT Pub. Date: Apr. 8, 2021

(65) Prior Publication Data

US 2022/0282427 A1 Sep. 8, 2022

(30) Foreign Application Priority Data

Sep. 30, 2019 (JP) ..... 2019-180255

(51) Int. Cl.
*A47L 13/17* (2006.01)
*D21H 19/24* (2006.01)
*D21H 27/30* (2006.01)

(52) U.S. Cl.
CPC ..... *D21H 27/30* (2013.01); *A47L 13/17* (2013.01); *D21H 19/24* (2013.01)

(58) Field of Classification Search
CPC ..... D21H 27/30; D21H 19/24; D21H 17/06; D21H 27/002; D21H 21/22; D21H 19/10; A47L 13/17
See application file for complete search history.

(56) References Cited

U.S. PATENT DOCUMENTS

| | | | | |
|---|---|---|---|---|
| 10,323,354 | B2 * | 6/2019 | Kawahara | D21H 11/18 |
| 10,422,084 | B2 * | 9/2019 | Mukoyama | D21H 27/02 |
| 10,925,443 | B2 * | 2/2021 | Izumi | D21H 27/00 |
| 11,272,824 | B2 * | 3/2022 | Mukoyama | A47K 10/16 |
| 2009/0197793 | A1 * | 8/2009 | Inoue | C11D 1/662 510/435 |
| 2018/0146834 | A1 * | 5/2018 | Izumi | D21H 19/34 |

(Continued)

FOREIGN PATENT DOCUMENTS

| | | | | |
|---|---|---|---|---|
| CA | 3045527 C | * | 12/2021 | D21H 17/07 |
| CN | 109790688 A | * | 5/2019 | A47K 10/16 |

(Continued)

OTHER PUBLICATIONS

Machine Translation of JP 2011030793 A. (Year: 2011).*

(Continued)

*Primary Examiner* — Jose A Fortuna
(74) *Attorney, Agent, or Firm* — Maier & Maier, PLLC

(57) ABSTRACT

A water dispersible sheet is a base paper sheet impregnated with a chemical solution. The base paper sheet is made of a water dispersible fiber aggregate. The water dispersible sheet includes diethylene glycol monobutyl ether and at least one or more glycol ethers other than diethylene glycol monobutyl ether in the chemical solution.

3 Claims, 4 Drawing Sheets

(56) References Cited

U.S. PATENT DOCUMENTS

| | | | | |
|---|---|---|---|---|
| 2019/0003128 | A1* | 1/2019 | Mukoyama | D21H 27/40 |
| 2019/0257032 | A1* | 8/2019 | Kawahara | D21H 19/34 |
| 2023/0167608 | A1* | 6/2023 | Kanamaru | D21H 25/02 162/158 |

FOREIGN PATENT DOCUMENTS

| | | | | | |
|---|---|---|---|---|---|
| EP | 0357496 | A2 | | 3/1990 | |
| EP | 357496 | B1 | * | 5/1994 | A47L 13/17 |
| EP | 3521511 | A1 | * | 8/2019 | A47K 10/16 |
| EP | 3521511 | A1 | | 8/2019 | |
| EP | 4137637 | A1 | * | 2/2023 | A47L 13/17 |
| EP | 4015706 | B1 | * | 12/2023 | A47L 13/17 |
| JP | 2008-045108 | A | | 2/2008 | |
| JP | 2009153740 | A | | 7/2009 | |
| JP | 2011-030793 | A | | 2/2011 | |
| JP | 5563254 | B2 | * | 7/2014 | A47L 13/17 |
| JP | 2016084565 | A | | 5/2016 | |
| JP | 2021055215 | A | * | 4/2021 | A47L 13/17 |
| JP | 2021085126 | A | * | 6/2021 | |
| WO | 2016/194460 | A1 | | 12/2016 | |
| WO | WO-2016194460 | A1 | * | 12/2016 | A47L 13/17 |
| WO | 2018/143095 | A1 | | 8/2018 | |
| WO | WO-2018143095 | A1 | * | 8/2018 | D21H 11/18 |
| WO | WO-2021106571 | A1 | * | 6/2021 | |
| WO | WO-2021182164 | A1 | * | 9/2021 | |

OTHER PUBLICATIONS

Office Action issued on Aug. 16, 2022, in connection with corresponding to Chinese Application No. 202080066322.X; 10 pages (including machine-generated English translation).

Office Action issued on Feb. 17, 2023, in corresponding Chinese Application No. 202080066322.X, 17 pages.

International Search Report dated Nov. 2, 2020 of corresponding application No. PCT/JP2020/034534; 5 pgs.

Office Action issued on Feb. 22, 2022 in corresponding Japanese Application No. 2019-180255; 5 pages including English-language translation.

Search Report issued on Sep. 13, 2022 in connection with corresponding European Application No. 20872932.7; 7 pages.

International Preliminary Report on Patentability with English translation issued on Apr. 5, 2022, in corresponding International Application No. PCT/JP2020/034534; 9 pages.

* cited by examiner

WATER DISPERSIBLE SHEET

TECHNICAL FIELD

The present invention relates to a water dispersible sheet.

BACKGROUND ART

In general, a toilet cleaning sheet, which is a water dispersible sheet, has surface strength so as not to tear when a toilet bowl is scrubbed with it, and a water dispersing property so as to be discarded as it is in water collected in the toilet bowl and to be flushed after completion of cleaning (see, for example, JP 2016-084565 A).

SUMMARY

However, while the conventional toilet cleaning sheet whose strength is prioritized has low water dispersing property, the sheet whose water dispersing property is prioritized has less strength and is torn easily during scrubbing of the toilet bowl.

Therefore, it has been difficult to both maintain the water dispersing property and improve resistance to being torn of a toilet cleaning sheet even in strong scrubbing.

Also, depending on the type of chemical solutions used, the user may suffer from hand roughness.

The present invention has been made in consideration of the above problems, and aims to provide a water-dispersible sheet having improved surface strength while the water dispersing property was maintained and hand roughness was suppressed.

In order to achieve the object, according to the invention recited in claim 1, there is provided a water dispersible sheet that is a base paper sheet impregnated with a chemical solution, the base paper sheet being made of a water dispersible fiber aggregate, including:

diethylene glycol monobutyl ether and at least one or more glycol ethers other than diethylene glycol monobutyl ether in the chemical solution.

According to the invention recited in claim 2, in the water dispersible sheet according to claim 1, the chemical solution contains propylene glycol monomethyl ether.

According to the invention recited in claim 3, in the water dispersible sheet according to claim 2, the chemical solution contains 11.50% by mass to 13.50% by mass of propylene glycol monomethyl ether.

According to the invention recited in claim 4, in the water dispersible sheet according to any one of claims 1 to 3, the chemical solution contains 3.00% by mass to 5.00 by mass of diethylene glycol monobutyl ether According to the present invention, it is possible to provide a water-dispersible sheet having improved surface strength while the water dispersing property was maintained and hand roughness was suppressed.

DESCRIPTION OF EMBODIMENTS

Hereinafter, with reference to FIG. 1 to FIG. 4B, the toilet cleaning sheet as a water dispersible sheet, an embodiment of the present invention, will be described in detail. However, the scope of the invention is not limited to the illustrated examples.

A toilet cleaning sheet will be described as an example of the water dispersible sheet, but the water dispersible sheet also includes a wet tissue impregnated with a chemical solution for use in wiping.

Figure 1:
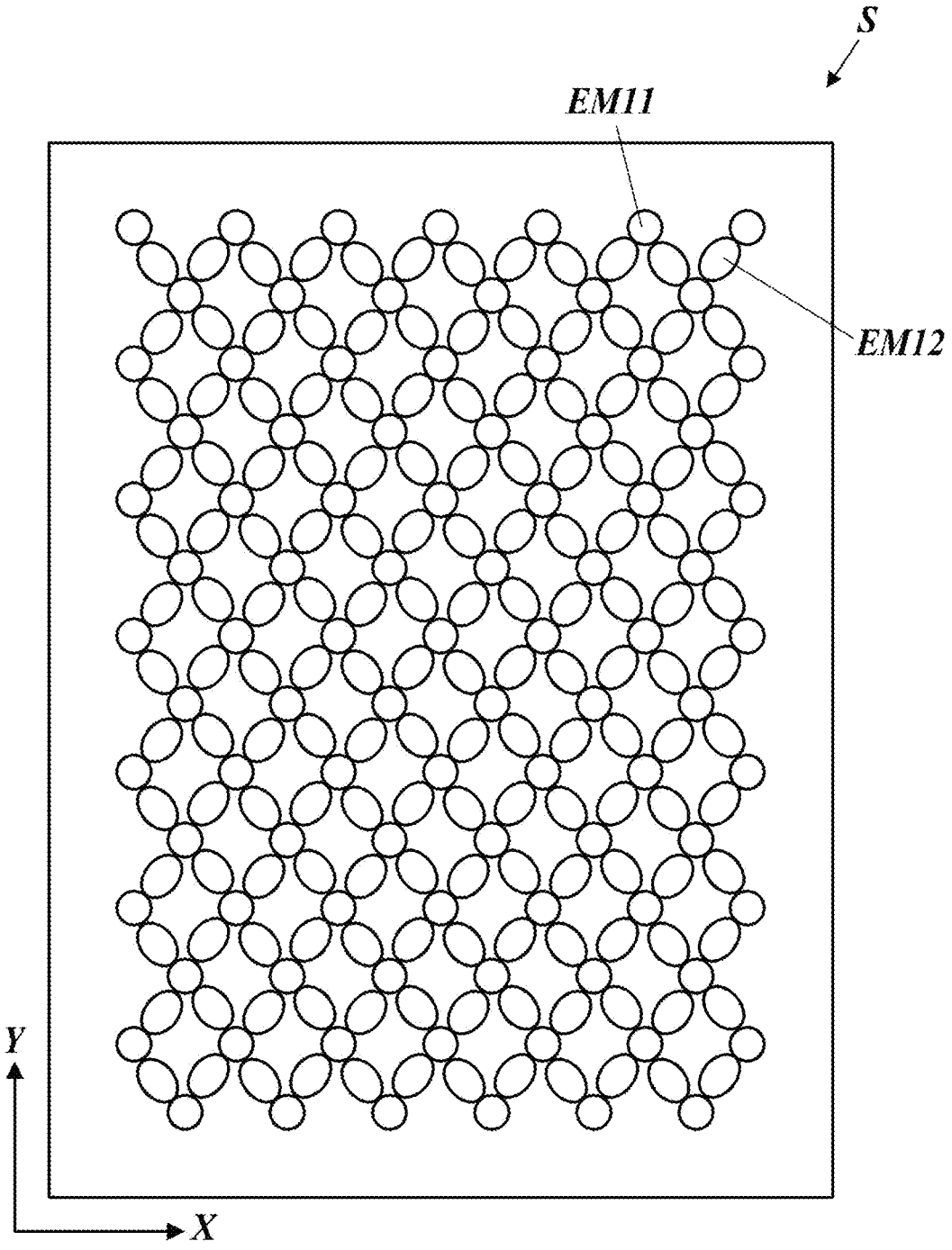
FIG. 1 is a plan view showing an example of a toilet cleaning sheet according to the present embodiment.
Figure 2A:
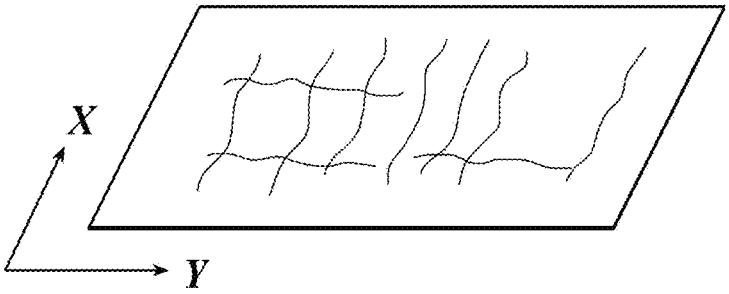
FIG. 2A is a view showing fiber orientation of a conventional sheet.
Figure 2B:
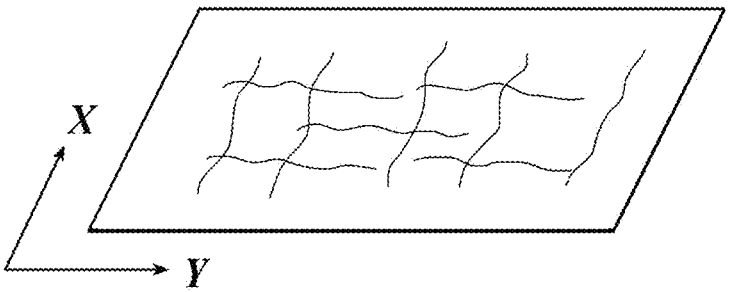
FIG. 2B is a view showing fiber orientation according to the present invention.

For convenience, X, Y, up and down, and left and right directions are defined as shown in FIG. 1, FIG. 2A, and FIG. 2B.

[Overall Structure]

The toilet cleaning sheet S of the present invention is a sheet in which base paper sheets are subjected to ply processing (stacked) and is preferably a toilet cleaning sheet of a wet type that is impregnated with a predetermined chemical solution.

The base paper sheet is preferably made by ply processing of two base paper sheets, because when it is made by ply processing of three or more base paper sheets, CMC described later is applied in a spotty manner.

The base paper sheet may also be composed of a single base paper sheet, without ply processing.

The surface of the toilet cleaning sheet S may be left as the original base paper sheet, but is preferably embossed. For example, two types of embosses EM11 and EM12 are provided as shown in FIG. 1.

The basis weight of the base paper sheet per sheet is about 30 to 150 g/m$^2$. The basis weight is based on JIS P 8124.

The base paper sheet of the toilet cleaning sheet S is configured with a water dispersible fiber aggregate so as to be discarded in the water collected in the toilet bowl as it is after cleaning the toilet bowl and the like.

[Fiber Aggregate]

The fiber aggregate is not particularly limited as long as it has a water dispersing property, but a single layer or multiple layers of paper or nonwoven fabric can be suitably used. The fiber raw material may be a natural fiber or a synthetic fiber, and they may be mixed. Suitable fiber raw materials include cellulosic fibers such as wood pulp, non-wood pulp, rayon, and cotton, biodegradable fibers made of polylactic acid, and the like. In addition, with these fibers as a main component, polyethylene fibers, polypropylene fibers, polyvinyl alcohol fibers, polyester fibers, polyacrylonitrile fibers, synthetic pulp, glass wool, and the like may be used in combination.

In particular, a fiber aggregate containing at least pulp is preferable, and suitable pulp to be used as a raw material is leaf bleached kraft pulp (LBKP) and needle bleached kraft pulp (NBKP) blended in an appropriate ratio.

The blended ratio of the leaf bleached kraft pulp more preferably exceeds 50% by mass, in other words, the blended ratio of the needle bleached kraft pulp to the leaf bleached kraft pulp is less than 1/1. By increasing the blended ratio of the leaf bleached kraft pulp to the needle bleached kraft pulp, gaps between fibers is reduced and moisture transpiration is suppressed. Therefore, it is possible to improve difficulty of drying of the toilet cleaning sheet S.

Further, it may be configured of a sheet made of crushed pulp or a sheet of crushed pulp covered or sandwiched with a water dispersible sheet(s).

[Water-Soluble Binder]

A water-soluble binder for enhancing paper strength is applied to the base paper sheet of the toilet cleaning sheet S. Examples of the water-soluble binder include a binder component such as carboxymethyl cellulose, polyvinyl alcohol, starch or a derivative thereof, hydroxypropyl cellulose, sodium alginate, trant gum, guar gum, xanthan gum, gum arabic, carrageenan, galactomannan, gelatin, casein, albumin, purplan, polyethylene oxide, Viscose, polyvinyl ethyl ether, sodium polyacrylate, sodium polymethacrylate, polyacrylamide, hydroxylated derivatives of polyacrylic acid, polyvinyl pyrrolidone/vinyl pyrrolidone vinyl acetate copolymer, and the like.

In particular, from the viewpoint of a good water dispersing property and the possibility of developing wet strength by cross-linking reaction, a water-soluble binder having a carboxyl group is preferably used.

The water-soluble binder having a carboxyl group is an anionic water-soluble binder which readily generates carboxylate in water. Examples thereof include polysaccharide derivatives, synthetic polymers, and natural products.

(Polysaccharide Derivative)

Examples of the polysaccharide derivative include a salt of carboxymethyl cellulose, carboxyethyl cellulose or a salt thereof, and carboxymethylated starch or a salt thereof, and an alkali metal salt of carboxymethyl cellulose (CMC) is particularly preferable.

(CMC)

It is desirable that CMC has an etherification degree of 0.6 to 2.0, particularly 0.9 to 1.8, more preferably 1.0 to 1.5. This is because the water dispersing property and the development of wet paper strength become extremely good.

It is preferable to use water-swellable CMC. This exerts a function of linking the fibers constituting the base paper sheet while remaining unswollen by forming cross-links with a specific metal ion as the cross-linking agent in the chemical solution, so that strength as a durable toilet wiping sheet in cleaning/wiping is exhibited.

In the present embodiment, CMC is applied to the toilet cleaning sheet S as the water-soluble binder.

The base paper sheet may be uniformly impregnated with CMC in the thickness direction, but is preferably impregnated with CMC such that the content of CMC in the base paper sheet gradually increases from the center in the thickness direction toward the front face and the back face. As a result, the if it is used for rubbing the rim of a toilet bowl strongly, as toilet cleaning sheet S is less likely to be torn compared with a conventional product which is uniformly impregnated with the water-soluble binder of the same amount.

(Synthetic Polymer)

Examples of the synthetic polymers include a salt of a polymer or a copolymer of an unsaturated carboxylic acid, a salt of a copolymer of an unsaturated carboxylic acid and a monomer copolymerizable with the unsaturated carboxylic acid, and the like. Examples of the unsaturated carboxylic acid include acrylic acid, methacrylic acid, itaconic acid, crotonic acid, maleic anhydride, maleic acid, fumaric acid, and the like. Examples of the monomer copolymerizable with them include esters of these unsaturated carboxylic acids, vinyl acetate, ethylene, acrylamide, vinyl ether, and the like. A particularly preferred synthetic polymer is one using acrylic acid or methacrylic acid as the unsaturated carboxylic acid, and specifically include salts of polyacrylic acid, polymethacrylic acid, or acrylic acid methacrylic acid copolymer, and salts of a copolymer of acrylic acid or methacrylic acid, an alkyl acrylate or alkyl methacrylate.

Examples of natural products include sodium alginate, xanthan gum, gellan gum, Tragacanth gum, pectin, and the like.

(CNF)

Cellulose nanofibers (hereinafter referred to as CNF) are added to the toilet cleaning sheet S.

That is, CNF can be added to the water-soluble binder (CMC in the present embodiment), and the specific surface area of the base paper sheet is larger than that with pulp-only composition.

CNF refers to fine cellulose fibers obtained by fibrillating pulp fibers. In general, CNF refers to cellulose fibers containing cellulose fine fibers having a fiber width of nano-order size (1 nm or more and 1000 nm or less). An average fiber width is preferably 100 nm or less. Number average, median, mode diameter (mode) and the like are calculated from a certain number of fibers as the average fiber width.

The base paper sheet may be uniformly impregnated with CNF in the thickness direction, but is preferably impregnated with CNF such that the content of CNF in the base paper sheet gradually increases from the center in the thickness direction toward the front face and the back face. As a result, even when it is used for rubbing the rim of a toilet bowl strongly, the toilet cleaning sheet S is less likely to be torn compared with a conventional product that is uniformly impregnated with the water-soluble binder of the same amount.

(Pulp Fiber Usable for CNF)

Examples of pulp fibers usable for the production of CNF include chemical pulp such as broad leaf tree pulp (LBKP) and needle leaf tree pulp (NBKP); mechanical pulp such as Bleaching thermomechanical pulp (BTMP), stone ground pulp (SGP), pressurized stone ground pulp (PGW), refiner ground pulp (RGP), chemi-ground pulp (CGP), thermogrand pulp (TGP), grand pulp (GP), thermomechanical pulp (TMP), chemi-Thermo Mechanical pulp (CTMP), and refiner mechanical pulp (RMP); used paper pulp manufactured from tea waste paper, craft envelope waste paper, magazine waste paper, newspaper waste paper, leaflets waste paper, office waste paper, cardboard waste paper, high quality white waste paper, Kent waste paper, simili waste paper, regional waste paper, and groundwood paper; and deinked pulp (DIP) made by deinking used paper pulp. As long as the effects of the present invention are not impaired, these may be used alone or in combination of multiple types.

(Fibrillation Methods of CNF)

Fibrillation methods used for producing CNF are not limited to, but include, for example, mechanical methods such as a high pressure homogenizer method, a microfluidizer method, a grinder grinding method, a bead mill freeze pulverization method, and an ultrasonic fibrillating method.

CNF that has been only mechanically treated by the above fibrillation methods (CNF without modification), namely, CNF that has been subjected to no modification with functional groups, has higher thermal stability and therefore can be used in a wider range of applications than CNF that has been subjected to modification with functional groups such as phosphate groups and carboxymethyl groups. However, CNF that has been subjected to modification with functional groups such as phosphate groups and carboxymethyl groups can also be used in the present invention.

Alternatively, for example, the pulp fiber may be mechanically treated by the fibrillation methods, and then chemically treated by carboxymethylation, or enzymatically treated. Chemically treated CNF include, for example, iCNF (individualized CNF) (single nanocellulose) having a diameter of 3 to 4 nm, such as TEMPO-oxidized CNF, phosphorylated CNF, and phosphite esterified CNF.

Alternatively, CNF treated only chemically or enzymatically, or CNF treated chemically or enzymatically and then treated mechanically by the fibrillation method may be used.

[Fiber Orientation Ratio]

The fiber orientation ratio (length/width) in the length and width directions of the toilet cleaning sheet S is not particularly limited, but is preferably 0.8 to 2.0, more preferably 0.8 to 1.2.

In the papermaking step which is a step for producing paper, since fibers are spread over wire(s) of a papermaking machine and flows in the transport direction, many fibers are generally aligned in the length direction, which is the conveyance direction of the papermaking machine (for example, length:width=2.3:1, refer to FIG. 2A), in the paper. Therefore, the fiber density in the width direction is low so that the fiber tends to break. That is, it tends to be torn depending on the wiping direction. Therefore, in the present embodiment, as shown in FIG. 2B, the fiber orientation ratio in the length and width directions of the toilet cleaning sheet S is set to 0.8 to 2.0, preferably 0.8 to 1.2. As a result, it is possible to provide the toilet cleaning sheet S which is hard to be torn even by wiping with it in any direction. The fiber orientation ratio in the length and width directions can be obtained from the ratio of the wet strengths in the directions of MD (Machine Direction) to CD (Cross Direction).

[Chemical Solution]

The toilet cleaning sheet S of the present embodiment is impregnated with a predetermined chemical solution containing the cross-linking agent that forms cross-links with the water-soluble binder (CMC in the case of the toilet cleaning sheet S of the present embodiment). In addition to this, the chemical solution contains an auxiliary agent such as glycol ethers, an aqueous detergent, an antiseptic, a disinfectant, an organic solvent, and the like.

After impregnated with the water-soluble binder and then dried, the base paper sheet is impregnated with the chemical solution.

The toilet cleaning sheet S is impregnated with the chemical solution of 100 to 500% by mass, preferably 150 to 300% by mass, relative to the mass of the base paper sheet as the base material of the toilet cleaning sheet S.

(Cross-Linking Agent)

As the cross-linking agent, boric acid, various metal ions and the like can be used, but when CMC is used as the water-soluble binder, a polyvalent metal ion is preferably used. In particular, it is preferable to use one or more of polyvalent metal ions selected from a group consisting of alkaline earth metals, manganese, zinc, cobalt, and nickel, from the viewpoint of developing wet strength for durability in use by sufficiently bonding the fibers and from the viewpoint of improving the sufficient water dispersing property. Among these metal ions, ions of calcium, strontium, barium, zinc, cobalt, or nickel are used particularly preferably.

(Glycol Ethers)

Glycol ethers have a structure in which a hydroxyl group at one or both ends of glycol, a divalent alcohol, is etherified, and have a hydrophobic alkyl group and a hydrophilic ether group and hydroxy group in the molecule. Glycol ethers have a lower molecular weight than surfactants and leads to a lower dynamic surface tension than conventional detergents containing only surfactants. Therefore, an interface between the chemical solution and stain can be formed more quickly. Glycol ethers also function as a coupling agent to compatibilize hydrophobic oil or stain with water, and can pull off stain and prevent it from reattaching. Therefore, the addition of glycol ethers to the chemical solution can improve the wiping performance of the toilet cleaning sheet S.

The chemical solution of the present invention includes glycol ethers such as: propylene glycol monomethyl ether (PGME), diethylene glycol monobutyl ether (DGME), ethylene glycol monomethyl ether, diethylene glycol monomethyl ether, triethylene glycol monomethyl ether, polyethylene glycol monomethyl ether, ethylene glycol isopropyl ether, diethylene glycol monoisopropyl ether, triethylene glycol monomethyl ether, polyethylene glycol monomethyl ether, ethylene glycol isopropyl ether, diethylene glycol monoisopropyl ether, and ethylene glycol monobutyl ether.

In particular, PGME, which is usually added as a detergent ingredient and is known to improve detergency, exhibits an effect of directly improving the sheet strength, and has an effect of enhancing the sheet strength improving effect due to the CMC and the polyvalent metal ion. As a result, a high deodorizing effect is considered to be exhibited. The amount of PGME to be added is preferably 20 to 60 $g/m^2$, more preferably 26 to 40 $g/m^2$. When the amount is less than 20 $g/m^2$, the deodorant effect is not sufficiently obtained. Even when the amount is more than 60 $g/m^2$, the obtained deodorant effect is not more than that when the amount is 60 $g/m^2$.

DGME is an auxiliary agent similar to PGME in that it has an effect of improving sheet strength. The amount of DGME to be added is preferably 5 to 30 $g/m^2$, more preferably 10 to 20 $g/m^2$.

However, when only DGME, which can improve the sheet strength most effectively, is added, sebum on the user's hands may be wiped off, which may cause hand roughness. Therefore, in order to improve the sheet strength while preventing hand roughness, glycol ethers such as PGME need to be formulated appropriately into the chemical solution in addition to DGME.

(Aqueous Detergent)

As the aqueous detergent, for example, lower or higher (aliphatic) alcohol can be used in addition to a surfactant.

(Antiseptic)

As the antiseptic, for example, parabens such as methylparaben, ethylparaben, propylparaben, and the like can used.

(Disinfectant)

As the disinfectant, for example, benzalkonium chloride, chlorhexidine gluconate, povidone iodine, ethanol, benzyl cetyl oxide, triclosan, chloroxylenol, isopropylmethylphenol, and the like can used. As the organic solvent, polyhydric alcohols such as glycol (divalent), glycerin (trivalent), sorbitol (tetravalent), and the like can used.

Further, the auxiliary agent of the above-mentioned components of the chemical solution can be selected appropriately, and a component which fulfills other functions may be contained in the chemical solution as necessary. For example, propylene glycol (PG) can be used as an auxiliary agent to solubilize the antiseptic and the disinfectant.

[Emboss]

Although the surface of the toilet cleaning sheet S may be the base paper sheet as it is, embossing is preferably applied. In the case of the toilet cleaning sheet S, for example, as shown in FIG. 1, two types of embosses EM11 and EM12 are embossed on it.

Although the shape, number, area ratio, and the like of the embosses are optional, in the case of the toilet cleaning sheet S, the embosses EM11 are arranged so as to form a diamond lattice. As a result, uneven wiping can be reduced as compared with the case where the embosses EM11 are arranged to form a square lattice or a rectangular lattice. The embosses EM12 are arranged between the embosses EM11.

Figure 3A:
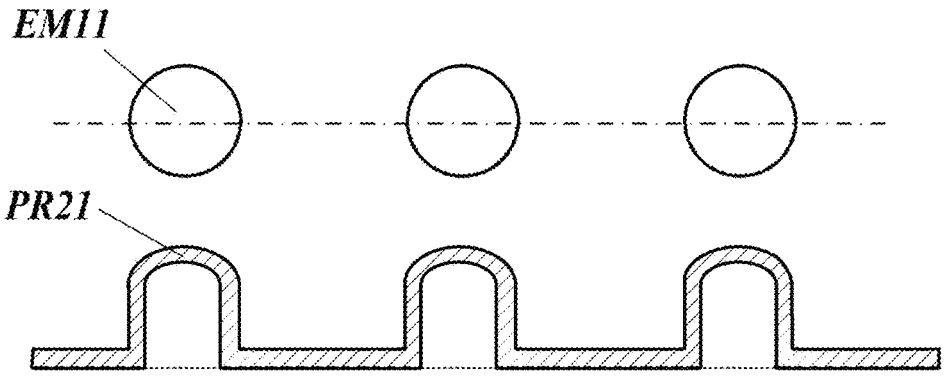
FIG. 3A is an enlarged view and a sectional view of one kind of emboss portions of the toilet cleaning sheet.

The embosses EM11 each have, as shown in FIG. 3A, a protrusion PR21 having a curved shape.

Figure 3B:
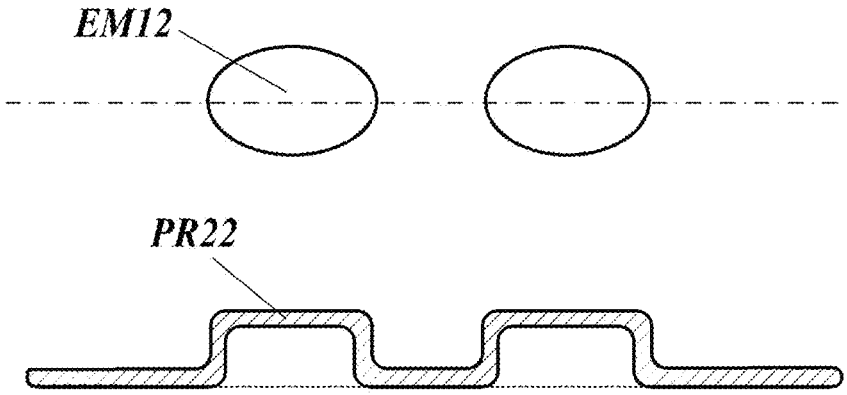
FIG. 3B is an enlarged view and a sectional view of the other kind of emboss portions of the toilet cleaning sheet.

The embosses EM12 each have, as shown in FIG. 3B, a protrusion PR22 having a plane shape.

Figure 3C:
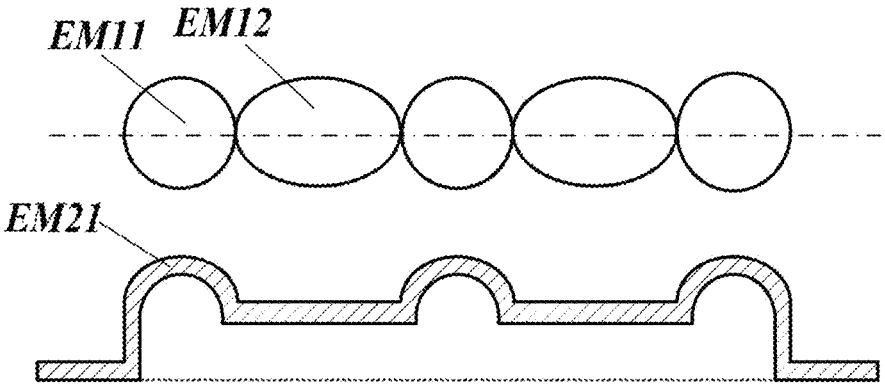
FIG. 3C is an enlarged view and a sectional view of a portion where the one kind of emboss portions and the other kind of emboss portions of the toilet cleaning sheet are close to each other.

Since the embosses EM12 are arranged between the embosses EM11, the protrusions PR21 of the embosses EM11 and the protrusions PR22 of the embosses EM12 are closely adhered to each other to form a continuous emboss EM21 as shown in FIG. 3C.

Alternatively, the protrusions PR21 of the embosses EM11 and the protrusions PR22 of the embosses EM12 may be only close to each other and do not have to be continuous.

By forming the two types of embosses EM11 and EM12 in this way, it is possible to increase contact areas with the object to be cleaned. As a result, the toilet cleaning sheet S becomes less stiff and has higher wiping property.

That is, by forming the embosses EM11 whose protrusions PR21 each have a curved surface and the embosses EM12 whose protrusions PR22 each have a plane surface on the entire surface of the toilet cleaning sheet S, the respective embosses are deformed and the contact areas increase for the first time when a force is applied to the toilet cleaning sheet S during the wiping operation. Therefore, as well as increasing the contact areas, flexibility is also improved due to deformation of the respective embosses.

Figure 4A:
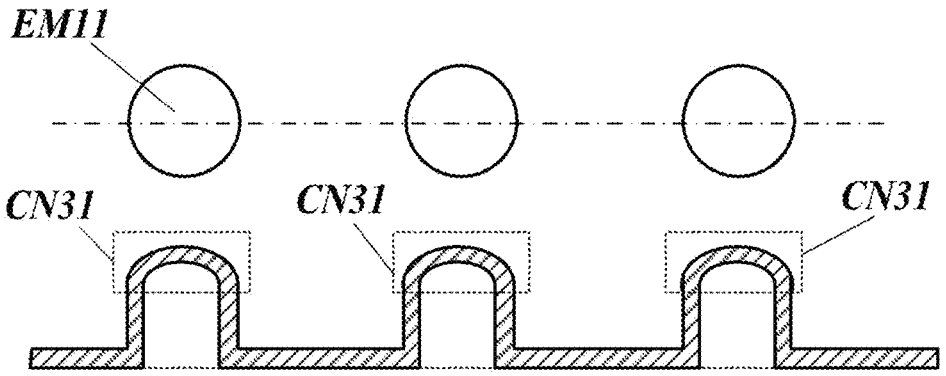
FIG. 4A is an explanatory view showing an example of a contact area of the one kind of embosses.
Figure 4B:
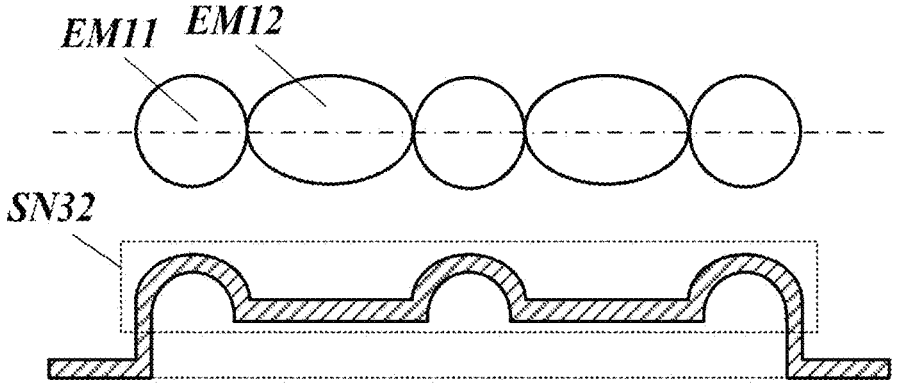
FIG. 4B is an explanatory view showing an example of a contact area of the portion where the one kind of emboss portions and the other kind of emboss portions of the toilet cleaning sheet are close to each other.

For example, as shown in FIG. 4A, if there is a single type of embosses EM11, the contact areas CN31 after deformation of the embosses EM11 due to the force applied to the toilet cleaning sheet S during the wiping operation are generated discretely in the vicinity of the respective embosses EM11. On the other hand, if there are two types of embosses EM11 and EM12 in combination, as shown in FIG. 4B, the contact areas SN32 after deformation of the embosses EM11 and EM12 due to the force applied to the toilet cleaning sheet S during the wiping operation are increased as compared with the contact area CN31 of FIG. 4A.

Further, the two types of the embosses EM11 and EM12 also exhibit the effect of normal embosses, and it is possible to improve the texture, absorbency, bulkiness, etc. of the toilet cleaning sheet S. Furthermore, as well as normal embosses, the continuous embosses EM21 also exhibit the effect of good appearance by embossing.

The toilet cleaning sheet S is folded in two at the center portion in the Y direction by a fold process. Then, it is stored in a plastic case for storage or in a packaging film in a folded state, and unfolded as necessary at the time of use. The way of folding the toilet cleaning sheet S is not limited to folding in two, but may be folding in four or eight, for example.

EXAMPLES

Next, evaluation results of preferred blended rate(s) of glycol ether(s) are explained in terms of surface strength, water dispersing property, and wiping performance for the examples and comparative examples of the present invention. Although the present invention will be explained in detail by means of the examples, the present invention is not limited to them.

[Sample Preparation]

First, as a raw fabric, a base paper sheet having a basis weight of 43 g/m$^2$ was prepared into two plies.

Next, a water-soluble binder solution consisting of 96% water and 4% CMC was sprayed on the outer surface of the raw fabric using a water-soluble binder application facility.

The CMC contained in the binder solution is CMC1330 (Daicel).

Next, the raw fabric was dried by being passed through a hot air dryer (temperature 180° C.) until the moisture content was about 8%, and a base paper sheet was prepared.

Then, the base paper sheet was impregnated with 200% by mass of the chemical solution to prepare a test sheet. The chemical solution includes 4.050% by mass of cross-linking agent, 0.200% by mass of the aqueous detergent, 0.205% by mass of the antiseptic, 0.200% by mass of the disinfectant, 3.000% by mass of PG, 75.845% by mass of purified water, and 16.500% by mass of the glycol ether(s) of respective blended rate(s) according to in Examples 1 to 5 and Comparative Examples 1 to 2.

Conditions of Examples 1 to 5 and Comparative Examples 1 to 2 are shown below.

The DGME used here is a linear compound.

Example 1

The blended rates of glycol ethers in the chemical solution were 1.000% by mass for DGME and 15.500% by mass for PGME.

Example 2

The blended rates of glycol ethers in the chemical solution were 3.000% by mass for DGME and 13.500% by mass for PGME.

Example 3

The blended rates of glycol ethers in the chemical solution were 5.000% by mass for DGME and 11.500% by mass for PGME.

Example 4

The blended rates of glycol ethers in the chemical solution were 8.250% by mass for both DGME and PGME.

Example 5

The blended rates of glycol ethers in the chemical solution were 10.000% by mass for DGME and 6.500% by mass for PGME.

Comparative Example 1

The blended rate of a glycol ether in the chemical solution was 16.500% by mass for PGME.

Comparative Example 2

The blended rate of a glycol ether in the chemical solution was 16.500% by mass for DGME.

The following tests 1 to 3 were conducted using the test sheets of the above examples and comparative examples.

[Test 1: Comparison of Surface Strength]

Surface strength was measured using a Gakushin type fastness rubbing tester.

<Test Method>

Test pieces (toilet cleaning sheets) were each cut out to be 75 mm in width and 240 mm in length in the MD and CD directions without peeling off the ply, folded in three such that both ends in the width direction overlapped, and each rubbed with a Gakushin type fastness rubbing tester at a portion to be measured. The number of rubbings was measured at the time when a damage such as scuffing or tear was visually recognized on the sheet. This measurement was performed three times in each of the MD direction and CD direction, and an average of the three measured values was calculated. The test conditions with the Gakushin type fastness rubbing tester were as follows.

Gakushin Type Fastness Rubbing Tester

Item Number AB301 manufactured by TESTER SANGYO CO,. LTD.

Rubbing Finger

Shape 20 m×R 50 mm

Load 200 gf (With white cotton cloth fixed, including arm)

Load Per Unit Area 50 gf/cm$^2$ (Load 200 gf/contact area 4.0 cm$^2$)

As the fixed cotton cloth for the rubbing finger, one piece of PP band (Sekisui Jushi Corporation, Item Number 19K (width 15 m×length 60 mm)) was fixed to the rubbing finger with screws such that there are no gaps or wrinkles.

Sample Holder

| | |
|---|---|
| Shape | R200 mm |
| Stroke | 120 mm |
| Reciprocating Frequency | 30 cps |

Test Piece (Toilet Cleaning)

Width 25 mm (the sheet with a width of 75 mm was folded in three without peeling off the ply)×length 240 mm (on the side of the sample holder)

Test Procedure (1) Mount the test piece on the sample holder so that it is not loose.

(2) Gently lower the rubbing finger to the sample holder.

(3) Press the start SW to start the test.

Judgment Method

By checking the state of the test piece after Gakushin processing (rubbing) of ten times, the number of rubbing was measured at the time when damage such as scuffing or tear was visually recognized on the sheet.

In the above test, a PP band with a mesh pattern on the surface is used as the rubbing finger, assuming a case where the toilet cleaning sheet is actually used, that is, a case where the rim of a toilet bowl is rough due to attached stains. As a result, it is possible to conduct an environmental test assuming the actual use of the toilet cleaning sheet and to obtain highly reliable evaluation result on whether or not the toilet cleaning sheet is durable when actually used.

[Test 2: Comparison of Water Dispersing Property]

The above test sheets of Examples and Comparative Examples were each cut into 114 m×114 mm and the water dispersing property of each of the test sheets was measured according to a method as in testing the ease of loosening based on JIS P 4501.

[Test 3: Comparison of Degree of Appearance of Hand Roughness]

Ten users cleaned a toilet space for three minutes using each of the test sheets of Examples and Comparative Examples and were each asked about the degree of appearance of hand roughness to answer with one of the following answers: "I do not feel hand roughness at all", "I feel a little hand roughness", and "I feel hand roughness."

The evaluation result was set to AA when the rate of users who answered that "I do not feel hand roughness at all" was the highest among the ten users, BB when the rate of users who answered that "I feel a little hand roughness" was the highest, and CC when the rate of users who answered that "I feel hand roughness" was the highest.

Table I shows averaged values of results of the above tests 1 and 2 each conducted four times, and values of results of the above test 3 that was conducted once, for each of the test sheets of the above examples and comparative examples.

TABLE I

| | Comparative Example 1 | Example 1 | Example 2 | Example 3 | Example 4 | Example 5 | Comparative Example 2 |
|---|---|---|---|---|---|---|---|
| DGME (% by mass) | 0.000 | 1.000 | 3.000 | 5.000 | 8.250 | 10.000 | 16.500 |
| PGME (% by mass) | 16.500 | 15.500 | 13.500 | 11.500 | 8.250 | 6.500 | 0.000 |
| Cross-Linking Agent (% by mass) | 4.050 | 4.050 | 4.050 | 4.050 | 4.050 | 4.050 | 4.050 |
| Aqueous Detergent (% by mass) | 0.200 | 0.200 | 0.200 | 0.200 | 0.200 | 0.200 | 0.200 |
| Antiseptic (% by mass) | 0.205 | 0.205 | 0.205 | 0.205 | 0.205 | 0.205 | 0.205 |
| Disinfectant (% by mass) | 0.200 | 0.200 | 0.200 | 0.200 | 0.200 | 0.200 | 0.200 |
| PG (% by mass) | 3.000 | 3.000 | 3.000 | 3.000 | 3.000 | 3.000 | 3.000 |
| Purified Water (% by mass) | 75.845 | 75.845 | 75.845 | 75.845 | 75.845 | 75.845 | 75.845 |
| Surface Strength (Times) | 161 | 398 | 374 | 474 | 358 | 327 | 362 |
| Water Dispersing Property (Seconds) | 56.00 | 54.00 | 60.00 | 60.00 | 48.00 | 57.00 | 46.00 |
| Hand Roughness | AA | AA | AA | AA | BB | BB | CC |

[Evaluation]

Comparison of Examples 1 to 3 with Comparative Example 1 revealed that the surface strength of the toilet cleaning sheet S to which 1.00 to 5. 00% by mass of DGME had been added was about 2.32 to 2.94 times of that of the toilet cleaning sheet S to which no DGME had been added.

This is assumed to be caused by the DGME that strengthens the surface strength more than PGME, because, while PGME easily permeates the entire sheet, DGME easily stays on the surface of the sheet.

Also, comparison of Examples 1 to 5 with Comparative Examples 1 to 2 revealed that the water dispersing property of the toilet cleaning sheet S was approximately constant regardless of the rate of the added DGME.

This is assumed to be because the water dispersing property was not affected by the glycol ethers whose the total amount to be added was 16.500% by mass in all cases.

Also, comparison of Examples 1 to 5 with Comparative Example 2 revealed that hand roughness began to appear when the added amount of DGME exceeded 5.00%, and hand roughness became more severe when it exceeded 10%.

This is assumed to be because DGME wipes off the sebum from the user's hands.

The following test 4 was further conducted using the test sheets of the above examples and comparative examples.

[Test 4: Comparison of Wiping Performance]

The above test sheets of Examples 1 to 5 and Comparative Examples 1 to 2 were each cut into 165 mm x230 mm, placed on a tile on which nine dots having a diameter of 1 mm were drawn with an oil-based magic marker to simulate sebum stains. Further, a weight of 1 kg was placed on each of the test sheets, wiping was performed at a constant speed, and the tile after the wiping was checked.

Then, the evaluation was made as follows. A sheet was evaluated as "AA" (no stain on the tile) when more than 90% of the area of the stained portion could be wiped off. A sheet was evaluated as "BB" (very little stain on the tile) when 60% or more and less than 90% of the area of the stained portion could be wiped off. A sheet was evaluated as "CC" (a slight stain on the tile) when 20% or more and less than 60% of the area of the stained portion could be wiped off. A sheet was evaluated as "DD" (a lot of stain on the tile) when less than 20% of the area of the stained portion could be wiped off.

The results of the test are shown in Table II.

TABLE II

| | Comparative Example 1 | Example 1 | Example 2 | Example 3 | Example 4 | Example 5 | Comparative Example 2 |
|---|---|---|---|---|---|---|---|
| DGME (% by mass) | 0.000 | 1.000 | 3.000 | 5.000 | 8.250 | 10.000 | 16.500 |
| PGME (% by mass) | 16.500 | 15.500 | 13.500 | 11.500 | 8.250 | 6.500 | 0.000 |
| Cross-Linking Agent (% by mass) | 4.050 | 4.050 | 4.050 | 4.050 | 4.050 | 4.050 | 4.050 |
| Aqueous Detergent (% by mass) | 0.200 | 0.200 | 0.200 | 0.200 | 0.200 | 0.200 | 0.200 |
| Antiseptic (% by mass) | 0.205 | 0.205 | 0.205 | 0.205 | 0.205 | 0.205 | 0.205 |
| Disinfectant (% by mass) | 0.200 | 0.200 | 0.200 | 0.200 | 0.200 | 0.200 | 0.200 |
| PG (% by mass) | 3.000 | 3.000 | 3.000 | 3.000 | 3.000 | 3.000 | 3.000 |
| Purified Water (% by mass) | 75.845 | 75.845 | 75.845 | 75.845 | 75.845 | 75.845 | 75.845 |
| Degree of Stain Removal | DD | CC | BB | BB | AA | AA | AA |

[Evaluation]

Comparison of Examples 1 to 5 with Comparative Examples 1 to 2 revealed that the wiping performance of the toilet cleaning sheet S was improved by addition of DGME to the chemical solution. In particular, by addition of DGME in an amount of 3.00% by mass or more, the wiping performance of the toilet cleaning sheet S was largely improved.

According to the above tests 1 to 4, it was found that, by impregnating the sheet with a chemical solution to which 3.00 to 5.00% by mass of DGME and 11.50 to 13.50% by mass of PGME were added, a toilet cleaning sheet S with excellent wiping performance and surface strength could be obtained while hand roughness was suppressed and the water dispersing property was maintained.

The present invention can be used for a water-dispersible sheet having improved surface strength while the water dispersing property was maintained and hand roughness was suppressed.

REFERENCE SIGNS LIST

S Toilet Cleaning Sheet (Water Dispersible Sheet)

EM11, 12, 21 Emboss

PR21, 22 Protrusion

CN31, SN32 Contact Area

The invention claimed is:

1. A water dispersible sheet that is a base paper sheet impregnated with a chemical solution, the base paper sheet being made of a water dispersible fiber aggregate joined by a water soluble binder, the water soluble binder configured to dissolve and permit dispersal of the water sheet when immersed in water, the chemical solution comprising:

3.00% by mass to 5.00% by mass of diethylene glycol monobutyl ether and at least one or more glycol ethers other than diethylene glycol monobutyl ether in the chemical solution.

2. The water dispersible sheet according to claim 1, wherein the chemical solution contains propylene glycol monomethyl ether.

3. The water dispersible sheet according to claim 2, wherein the chemical solution contains 11.50% by mass to 13.50% by mass of propylene glycol monomethyl ether.

* * * * *